US007267533B1

(12) United States Patent
Tocci et al.

(10) Patent No.: US 7,267,533 B1
(45) Date of Patent: Sep. 11, 2007

(54) PLUNGER ASSEMBLY FOR USE IN RECIPROCATING FLUID PUMP EMPLOYING REVERSING POLARITY MOTOR

(75) Inventors: Raul A. Tocci, Kenosha, WI (US); Martin L. Radue, Kenosha, WI (US)

(73) Assignee: BRP US Inc., Sturtevant, WI (US)

( * ) Notice: Subject to any disclaimer, the term of this patent is extended or adjusted under 35 U.S.C. 154(b) by 628 days.

(21) Appl. No.: 10/708,097

(22) Filed: Feb. 9, 2004

(51) Int. Cl.
*F04B 53/12* (2006.01)
*F04B 17/04* (2006.01)
*F04B 35/04* (2006.01)

(52) U.S. Cl. ..... 417/552; 417/416; 417/417; 123/499

(58) Field of Classification Search ..... 417/416, 417/417, 552, 410.1, 415, 437, 545, 549, 417/553; 123/499; 310/12, 14, 15, 23, 17
See application file for complete search history.

(56) References Cited

U.S. PATENT DOCUMENTS 4,147,476 A * 4/1979 Warren ..... 417/328
6,398,511 B1 * 6/2002 French et al. ..... 417/53
6,964,263 B2 * 11/2005 Xi et al. ..... 123/499

* cited by examiner

*Primary Examiner*—Anthony Stashick
*Assistant Examiner*—Tresa V. Vidayathil
(74) *Attorney, Agent, or Firm*—Osler, Hoskin & Harcourt LLP

(57) ABSTRACT

A reciprocating pump includes a drive section and a pump section. The drive section has a reciprocating coil assembly to which alternating polarity control signals are applied during operation. A permanent magnet structure of the drive section creates a magnetic flux field which interacts with an electromagnetic field produced during application of the control signals to the coil. The coil assembly includes a drive member that drives a plunger assembly having a plunger and a valve stem movably interfitted within the plunger and having a lower poppet head. As the plunger is driven downwardly the plunger contacts the poppet head to drive it into the pump chamber to force the fluid therefrom. There is a gap between the poppet head and the plunger so that the initial downward movement of the plunger closes the gap to gain momentum before it contacts the poppet head and drives it downwardly.

20 Claims, 6 Drawing Sheets

PLUNGER ASSEMBLY FOR USE IN RECIPROCATING FLUID PUMP EMPLOYING REVERSING POLARITY MOTOR

BACKGROUND OF INVENTION

The present invention relates generally to the field of electrically-driven reciprocating pumps. More particularly, the invention relates to a pump which is particularly well suited for use as a fuel pump, driven by a drive assembly employing permanent magnets and a solenoid coil to produce pressure variations in a pump section and thereby to draw into and express from the pump section a fluid, such as a fuel being pumped.

A wide range of pumps have been developed for displacing fluids under pressure produced by electrical drives. For example, in certain fuel injection systems, fuel is displaced via a reciprocating pump assembly which is driven by electric current supplied from a source, typically a vehicle electrical system. In one fuel pump design of this type, a pump and nozzle assembly includes a drive section and a pump section. The drive section includes a drive assembly that is energized by the electric current to provide motion to the pump section to cause the pump section to pump the fuel. The drive assembly is held in a fixed position within a drive section housing and includes one or more permanent magnets, with an electrical coil surrounding the permanent magnets. The electrical coil is wound about a coil bobbin and is movable in a reciprocating motion by the energizing and de-energizing by the electrical signals and transmits that reciprocating motion to the pump section by a drive member that is affixed to the coil bobbin. The reciprocating motion of the drive member is transmitted to a plunger assembly comprised of a plunger that is in contact with the drive member and which extends into a pump chamber where the fluid is drawn into the pump chamber and expelled therefrom by the motion of the plunger assembly. As such, the reciprocal movement of the drive member causes the plunger assembly to pump the fluid from the pump chamber for use in a combustion chamber.

One problem, therefore, in the construction of the plunger assembly is to make the plunger assembly of a small length so as to reduce the overall size of the components of the pump.

There is a need, therefore, for an improved technique for constructing a plunger assembly for use in a fluid pump wherein the assembly is dimensionally reduced in length to produce a more compact, smaller construction of an internal combustion engine.

BRIEF DESCRIPTION OF INVENTION

The present invention provides a novel technique for pumping fluids in a reciprocating pump arrangement designed to respond to these needs. The technique is particularly well suited for use in fuel delivery systems, such as in direct, in chamber, fuel injection. However, the technique is in no way limited to such applications, and may be employed in a wide range of technical fields.

The technique is based upon a construction that provides a unique means of minimizing, to some extent, the overall length of plunger assembly contained within a pump section of the fluid pump and which is driven by a reciprocating motion of a drive section. In the present system, there is a drive system employing at least one permanent magnet and at least one coil assembly. The coil assembly includes a coil bobbin around which is located the coil and that coil is energized cyclically to produce reciprocating motion of the coil bobbin and which reciprocating motion is transmitted to a drive member that, in turn, provides the reciprocating movement to the plunger assembly of the present invention. The plunger assembly is constructed through use of the present invention wherein there is included a plunger that is moved between upper and lower positions by the reciprocating motion of the drive member and the plunger has an internal passageway passing through the plunger and within which is located a valve stem having a poppet head at its lower end and a pliable nipple at its upper end. There is a gap, that is formed between the poppet head and the lower end of the plunger when the plunger is in its upper position that allows fluid to enter the passageway and a spring bias biases the plunger to the upper position. The reciprocating motion of the drive member forces the plunger downwardly where it contacts the poppet head, after traveling the distance of the gap and forces the poppet head downwardly into the pump chamber to propel the fluid therefrom. Valves, such as check valves, within the pump section are actuated by the variations in pressure, permitting fluid to be drawn into the pump section and expressed therefrom.

BRIEF DESCRIPTION OF DRAWINGS

The foregoing and other advantages of the invention will become apparent upon reading the following detailed description and upon reference to the drawings in which.

DETAILED DESCRIPTION

Figure 1:
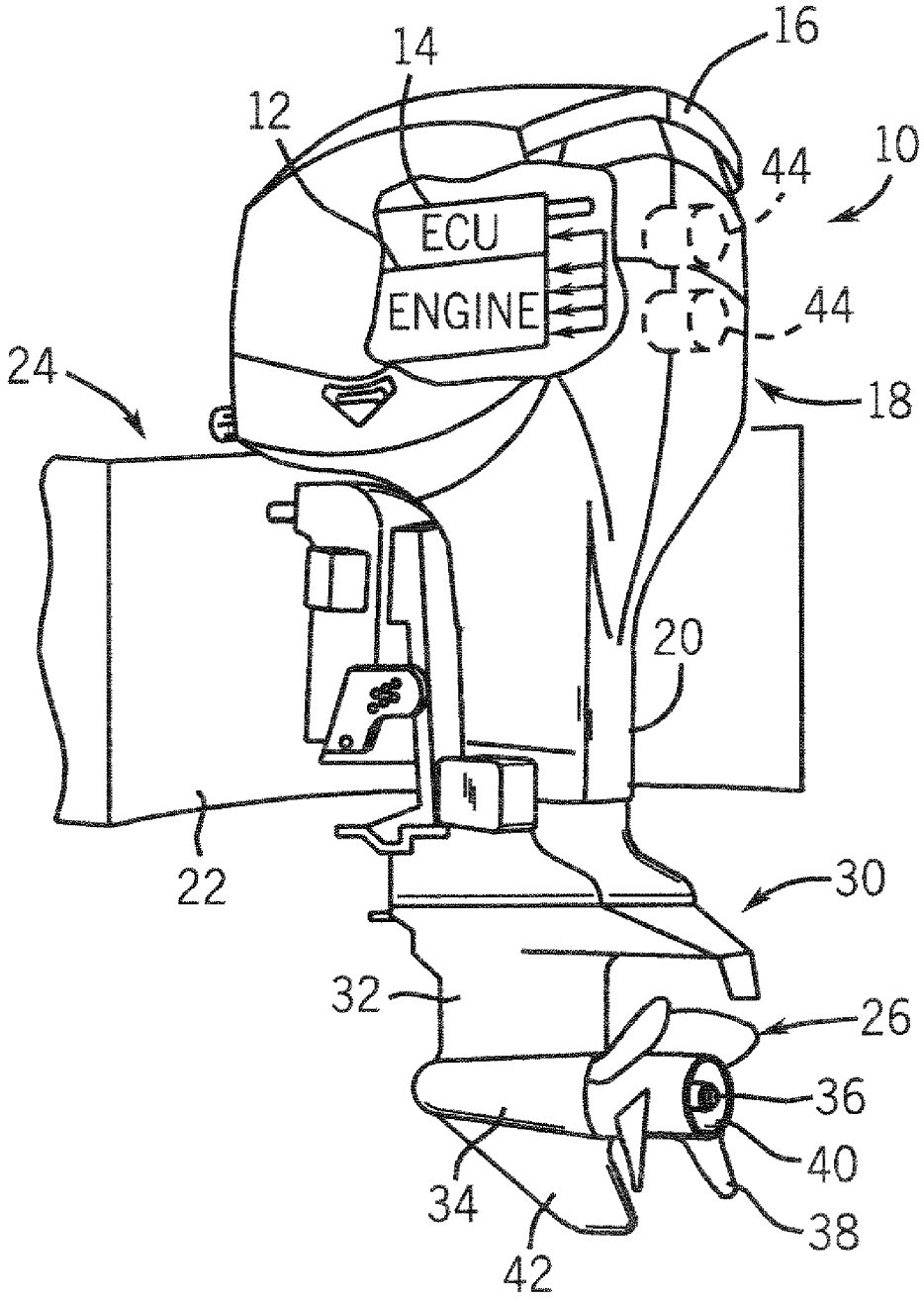
FIG. 1 is a perspective view of an exemplary outboard motor incorporating the present invention.

The present invention relates generally to internal combustion engines, and preferably, those incorporating direct fuel injection in a spark-ignited two-cycle gasoline-type engine. FIG. 1 shows an outboard motor 10 having one such engine 12 controlled by an electronic control unit (ECU) 14 under engine cover 16. Engine 12 is housed generally in a powerhead 18 and is supported on a midsection 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via midsection 20. A skeg 42 depends vertically downwardly from torpedo section 34 to protect propeller fins 38 and encourage the efficient flow of outboard motor 10 through water. There are also shown fuel injectors 44 located beneath the engine cover 16 for supplying the fuel to the cylinders of the outboard motor 10. In the embodiment illustrated, the outboard motor 10 is a two cylinder engine and therefore there are two fuel injectors 44 illustrated, however, certainly more or less cylinders and corresponding fuel injectors 44 can be used in carrying out the present invention.

Figure 2:
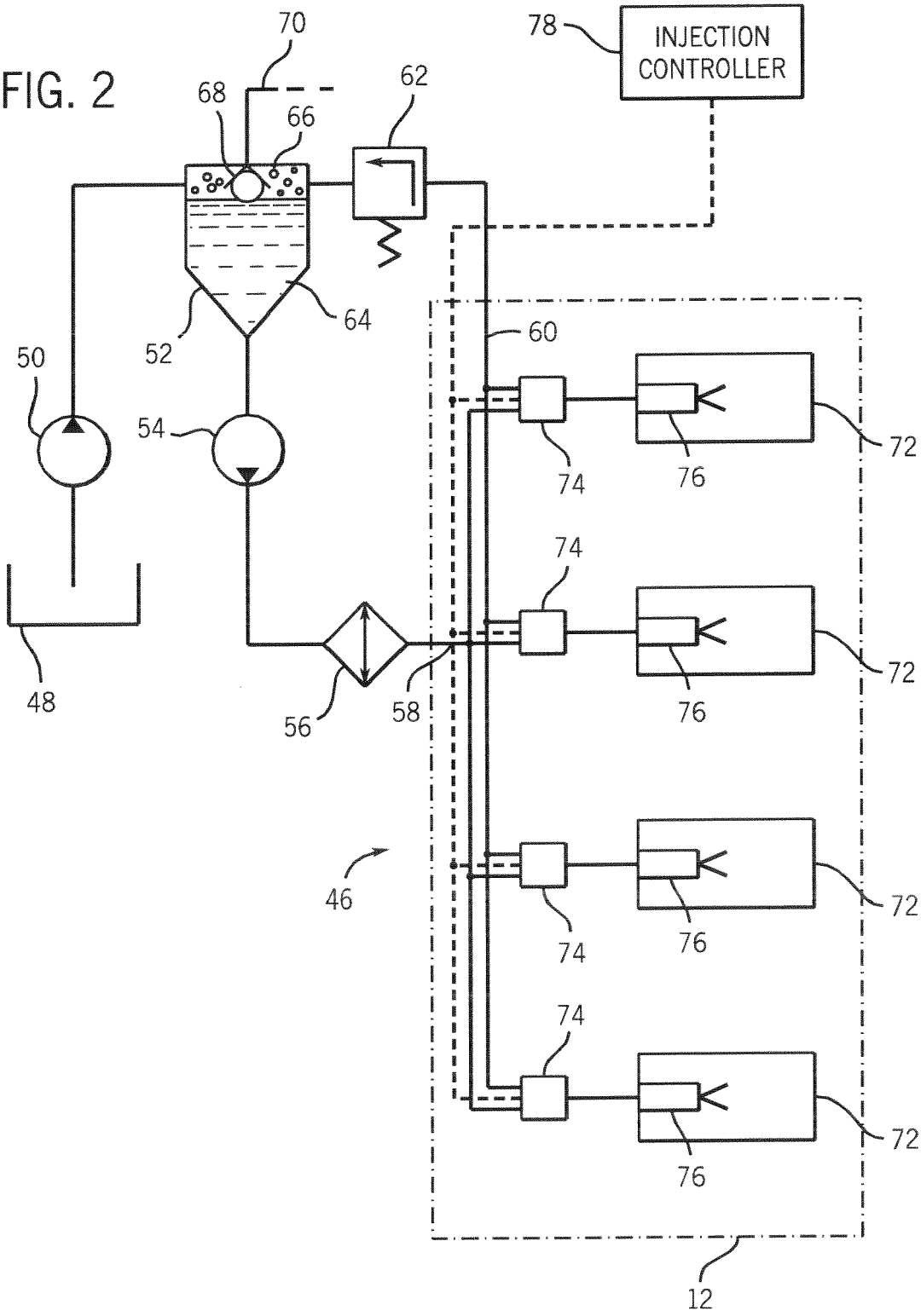
FIG. 2 is a diagrammatical representation of a series of fluid pump assemblies applied to inject fuel into an internal combustion engine.

FIG. 2 diagrammatically illustrates a fuel injection system 46, including a series of pumps for displacing fuel under pressure in an internal combustion engine such as the engine 12. While the fluid pumps of the present technique may be employed in a wide variety of settings, they are particularly well suited to fuel injection systems in which relatively small quantities of fuel are pressurized cyclically to inject the fuel into combustion chambers of an engine as a function of the engine demands. The pumps may be employed with individual combustion chambers as in the illustrated embodiment, or may be associated in various ways to pressurize quantities of fuel, as in a fuel rail, feed manifold, and so forth. Even more generally, the present pumping technique may be employed in settings other than fuel injection, such as for displacing fluids under pressure in response to electrical control signals used to energize coils of a drive assembly, as described below.

In the embodiment shown in FIG. 2, the fuel injection system 46 includes a fuel reservoir 48, such as a tank for containing a reserve of liquid fuel. A first pump 50 draws the fuel from the fuel reservoir 48, and delivers the fuel to a separator 52. While the system may function adequately without a separator 52, in the illustrated embodiment, separator 52 serves to insure that the fuel injection system downstream receives liquid fuel, as opposed to mixed phase fuel. A second pump 54 draws the liquid fuel from separator 52 and delivers the fuel, through a cooler 56, to a feed or inlet manifold 58. Cooler 56 may be any suitable type of fluid cooler, including both air and liquid heater exchangers, radiators, and so forth.

Fuel from the feed manifold 58 is available for injection into combustion chambers of engine 12, as described more fully below. A return manifold 60 is provided for recirculating fluid not injected into the combustion chambers of the engine. In the illustrated embodiment a pressure regulating valve 62 is placed in series in the return manifold 60 for maintaining a desired pressure within the return manifold 60. Fluid returned via the pressure regulating valve 62 is recirculated into the separator 52 where the fuel collects in liquid phase as illustrated at reference numeral 64. Gaseous phase components of the fuel, designated by referenced numeral 66 in FIG. 2, may rise from the fuel surface and, depending upon the level of liquid fuel within the separator 52, may be allowed to escape via a float valve 68. A vent 70 is provided for permitting the escape of gaseous components, such as for repressurization, recirculation, and so forth.

Engine 12 includes a series of cylinders or combustion chambers 72 for driving an output shaft (not shown) in rotation. As will be appreciated by those skilled in the art, depending upon the engine design, pistons (not shown) are driven in a reciprocating fashion within each combustion chamber 72 in response to ignition of fuel within the combustion chamber 72. The stroke of the piston within the combustion chamber 72 will permit fresh air for subsequent combustion cycles to be admitted into the combustion chamber 72, while scavenging combustion products from the combustion chamber 72. While the present embodiment employs a straightforward two-stroke engine design, the pumps in accordance with the present technique may be adapted for a wide variety of applications and engine designs, including other than two-stroke engines and cycles.

In the illustrated embodiment, a reciprocating pump 74 is associated with each combustion chamber 72, drawing pressurized fuel from the feed manifold 58, and further pressurizing the fuel for injection into the respective combustion chamber 72. A nozzle 76 is provided for atomizing the pressurized fuel downstream of each reciprocating pump 74. While the present technique is not intended to be limited to any particular injection system or injection scheme, in the illustrated embodiment a pressure pulse created in the liquid fuel forces a fuel spray to be formed at the mouth or outlet of the nozzles 76, for direct, in-cylinder injection. The operation of reciprocating pumps 74 is controlled by an injection controller 78. Injection controller 78, which will typically include a programmed microprocessor or other digital processing circuitry, and memory for storing a routine employed in providing control signals to the pumps, applies energizing signals to the reciprocating pumps 74 to cause their reciprocation in any one of a wide variety of manners as described more fully below.

Figure 3:
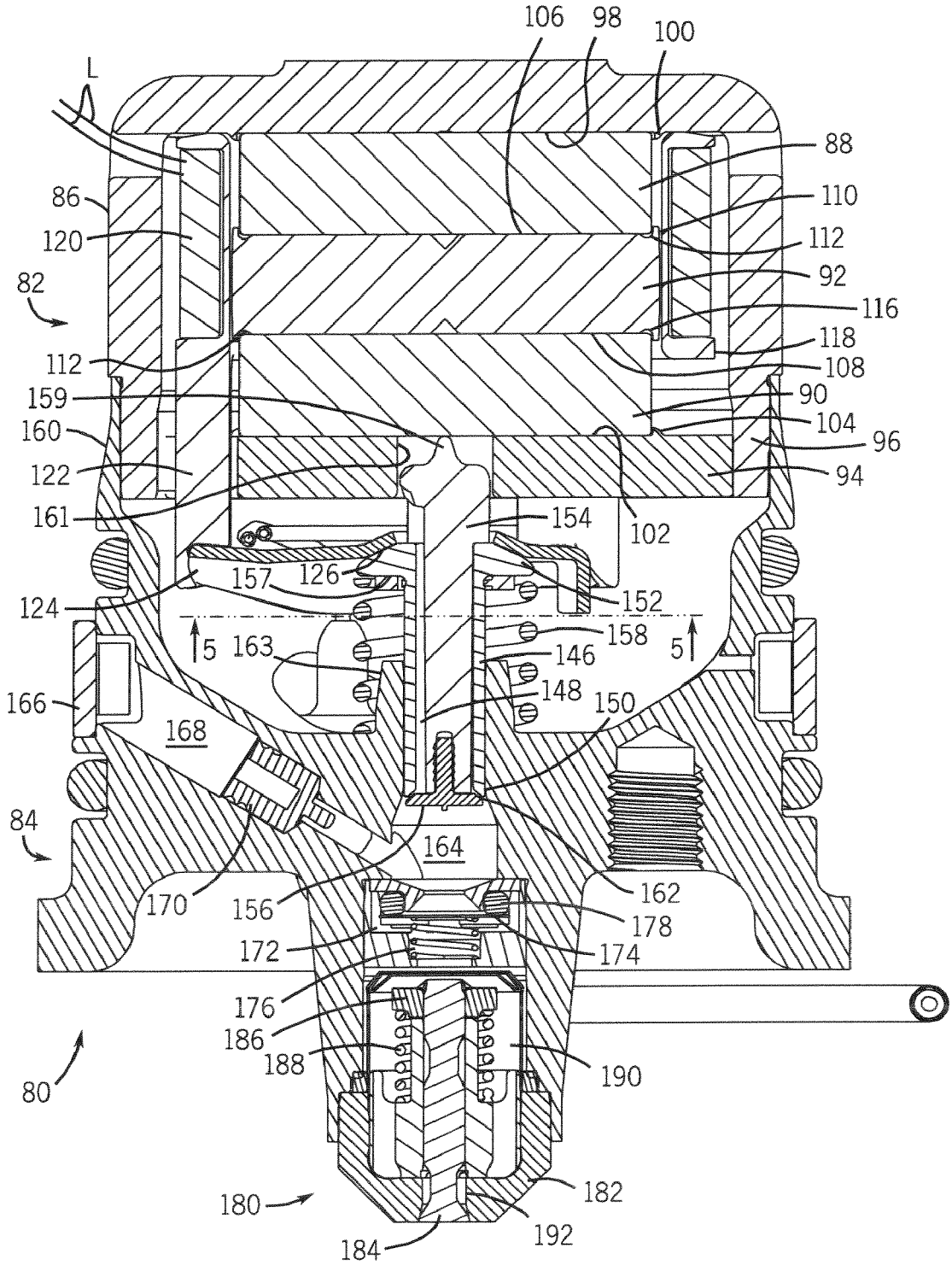
FIG. 3 is a partial sectional view of an exemplary pump in accordance with aspects of the present technique for use in displacing fluid under pressure, such as for fuel injection into a chamber of an internal combustion engine as shown in FIG. 1.

An exemplary reciprocating pump assembly, such as for use in a fuel injection system of the type illustrated in FIG. 2, is shown in FIG. 3. Specifically, FIG. 3 illustrates a pump and nozzle assembly 80 which incorporates a pump constructed in accordance with the present techniques. Assembly 80 essentially comprises a drive section 82 and a pump section 84. The drive section 82 is designed to cause reciprocating pumping action within the pump section 84 in response to application of reversing polarity control signals applied to an actuating coil of the drive section 82 as described in greater detail below. The characteristics of the output of the pump section 84 may thus be manipulated by altering the waveform of the alternating polarity signal applied to the drive section 82. In the presently contemplated embodiment, the pump and nozzle assembly 80 illustrated in FIG. 3 is particularly well suited to application in an internal combustion engine, as in the components illustrated in FIG. 2 as reciprocating pumps 74. Moreover, in the embodiment illustrated in FIG. 3, a nozzle assembly is installed directly at an outlet of the pump section 84, such that the reciprocating pump 74 and the nozzle 76 of FIG. 2 are incorporated into a single assembly or unit. As indicated above, in appropriate applications, the pump illustrated in FIG. 3 may be separated from the nozzle, such as for application of fluid under pressure to a manifold, fuel rail, or other downstream component.

Figure 4:
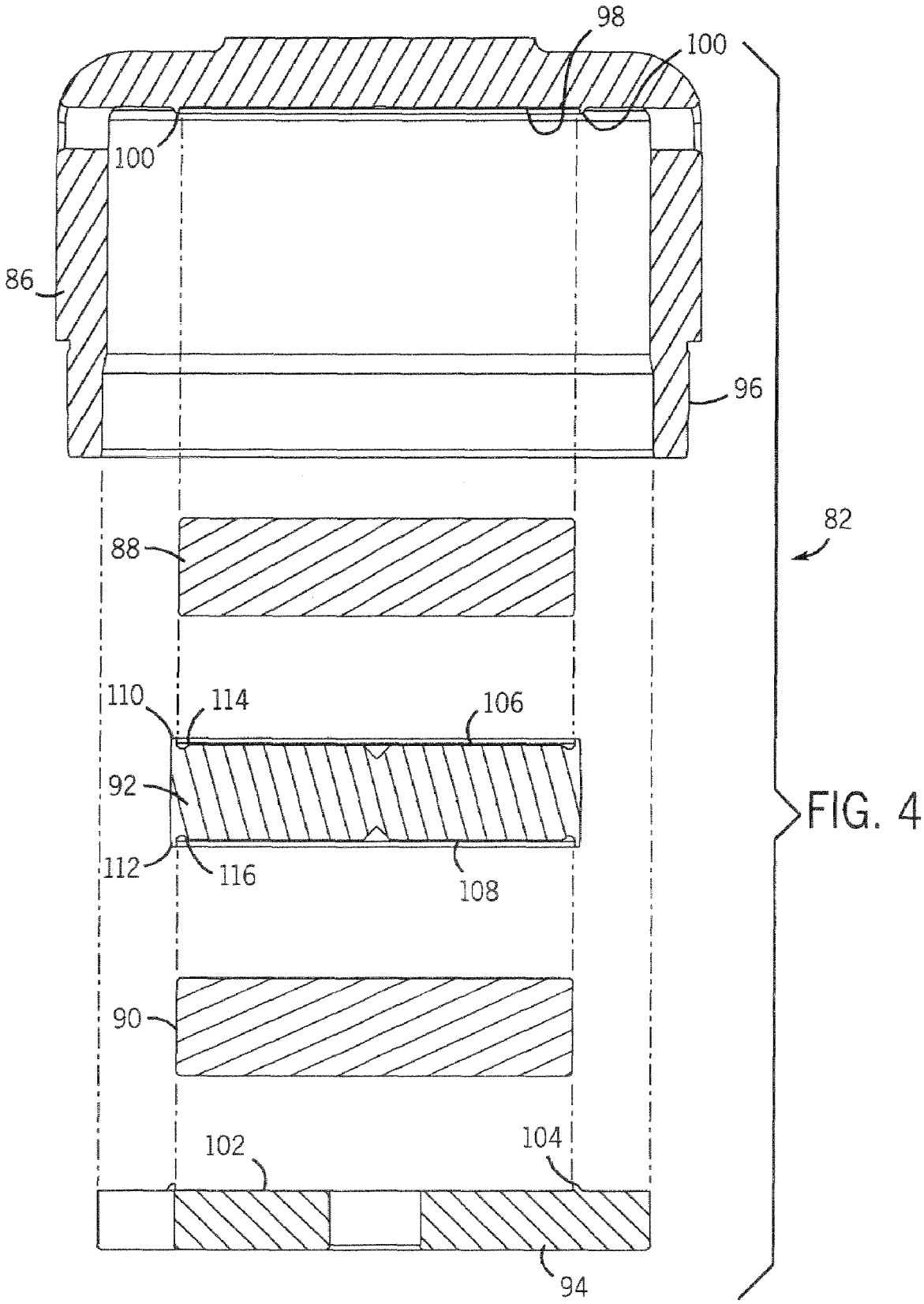
FIG. 4 is an exploded view of the drive section of the exemplary pump of FIG. 3.

As illustrated in FIG. 4, there is an exploded view of the drive section 82, taken along with FIG. 3, drive section 82 includes a housing 86 designed to sealingly receive the drive section components and support them during operation. The drive section 82 further includes at least one permanent magnet 88, and in the preferred embodiment illustrated, a pair of permanent magnets 88 and 90. The permanent magnets 88, 90 are separated from one another and disposed adjacent to a central spacer 92 made of a material which is capable of conducting magnetic flux, such as a ferromagnetic material.

Drive section 82 also includes a base plate 94 that is forcefully fitted into the lower skirt 96 of the housing 86 to retain the permanent magnets 88 and 90 as well as the central spacer 92 fixedly supported within the housing 86 and also to separate the drive section 82 from the pump section 84. Thus, the sandwiching of the permanent magnets 88, 90 within the housing 86 and the base plate 94, prevent the axial movement of the permanent magnets 88, 90 as well as the central spacer 92. The permanent magnets 88, 90 and the central spacer 92 are prevented from movement in a radial or lateral direction by means of pockets that are formed to retain the permanent magnets 88, 90 held in a fixed position between the housing 86 and the base plate 94.

Accordingly, as can be seen, there is a housing pocket 98 that is formed in the undersurface of the housing 86. Preferably, that housing pocket 98 is created by an outwardly projecting lip 100 formed on that undersurface and the outwardly projecting lip is configured to be the same peripheral shape as the external perimeter of the permanent magnet 88 so that the upper surface of the permanent magnet 88 fits snugly within the outwardly projecting lip and is thereby constrained against radial or lateral movement with respect to the housing 86.

In a similar manner, there is a base plate pocket 102 that is formed in the upper surface of the base plate 94 and, again, that base plate pocket 102 can be created by an outwardly projecting lip 104 formed on that upper surface. That outwardly projecting lip 104 is also configured to conform to the shape of the outer perimeter of the permanent magnet 90 so that the permanent magnet 90 fits snugly into the base plate pocket 102 and is held tightly therein and prevented from radial or lateral movement with respect to the base plate 94. In an embodiment, the perimeter of the permanent magnets 88, 90 is circular, that is the permanent magnets 88, 90 are cylindrical in overall shape, and the outwardly projecting lips 100, 104 are also circular. It is preferred that the outwardly projecting lips extend fully around the outer perimeter of the permanent magnets 88, 90, however, there may be spaces or they may extend only partially there around, it only being of importance that the outwardly projecting lips 100, 104 be sufficiently long to prevent the radial or lateral movement of the permanent magnets 88, 90.

There are also pockets formed on the external surfaces of the central spacer 92, that is, the surfaces that contact the permanent magnets 88, 90 and are shown as upper spacer pocket 106 and lower spacer pocket 108. In both instances the upper and lower spacer pockets 106, 108 are formed by outwardly projecting lips 110 and 112, respectively. Again the outwardly projecting lips 110, 112 are configured to closely enwrap the permanent magnets 88, 90 to prevent the movement with respect to the central spacer 92 and, in one embodiment, the outwardly projecting lips 110, 112 are circular to abut closely against and enclose the outer perimeter of cylindrical shaped permanent magnets 88, 90.

The center spacer 92 also has formed on its outer surfaces, annular grooves 114, 116 that are located just internal of the outwardly projecting lips 110, 112 respectively, and which annular grooves 114, 116 provide a relief to the affixing together of two relatively planar surfaces to allow those surfaces to be brought together in a close abutting relationship.

As can now be seen, the drive section 82 is constructed with the permanent magnets 88, 90 held together by the housing 86 and the base plate 94 with the central spacer 92 affixed therebetween and the permanent magnets 88 and 90 are held axially by the engagement of the base plate 94 within the lower skirt 96 of the housing 86 and are held against radial or lateral movement by having the outer perimeters of the external surfaces of the permanent magnets 88, 90 tightly interfitted within housing pocket 98, base plate pocket 102 and the upper and lower spacer pockets 106, 108. Thus, the assembly and construction of the drive section 82 is facilitated by the use of the pockets to contain, center and prevent the movement of the permanent magnets in the drive section 82.

Returning to FIG. 3, a coil bobbin 118 is disposed about permanent magnets 88, 90, and central spacer 92. While permanent magnets 88 and 90, and central spacer 92 are fixedly supported within housing 86 as previously described, coil bobbin 118 is free to slide longitudinally with respect to those components. That is, coil bobbin 118 is centered around central spacer 92, and may slide with respect to the central spacer 92 upwardly and downwardly in the orientation shown in FIG. 3. A coil 120 is wound within coil bobbin 118 and free ends of the coil 120 are coupled to leads L for receiving energizing control signals, such as from an injection controller 78, as illustrated in FIG. 2. Coil bobbin 118 further includes a plurality of bobbin legs 122 which protrude from the region of the coil bobbin 118 in which the coil 120 is installed for driving the pump section 84 as described below. Only one bobbin leg 122 is shown in FIG. 3, however, in the embodiment to be described, three bobbin legs 122 are utilized and are spaced equidistant around the periphery of the coil bobbin 118, that is, about 120 degrees apart around the coil bobbin 118. Those three bobbin legs 122 therefore extend downwardly through three grooves correspondingly formed in the outer periphery of the base plate 94. It should be noted, however, that in the illustrated embodiment, the inner volume of the drive section, including the volume in which the coil 120 is disposed, may be flooded with fluid during operation, such as for cooling purposes. A drive member 124 is secured to coil bobbin 118 via the bobbin legs 122.

Figure 5:
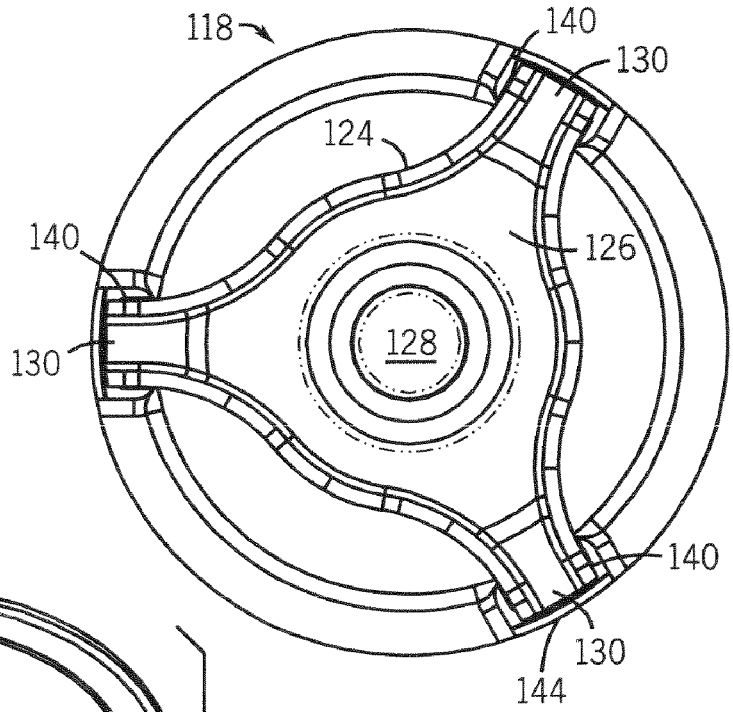
FIG. 5 is a bottom view of a bobbin and drive member used in the present invention.
Figure 6:
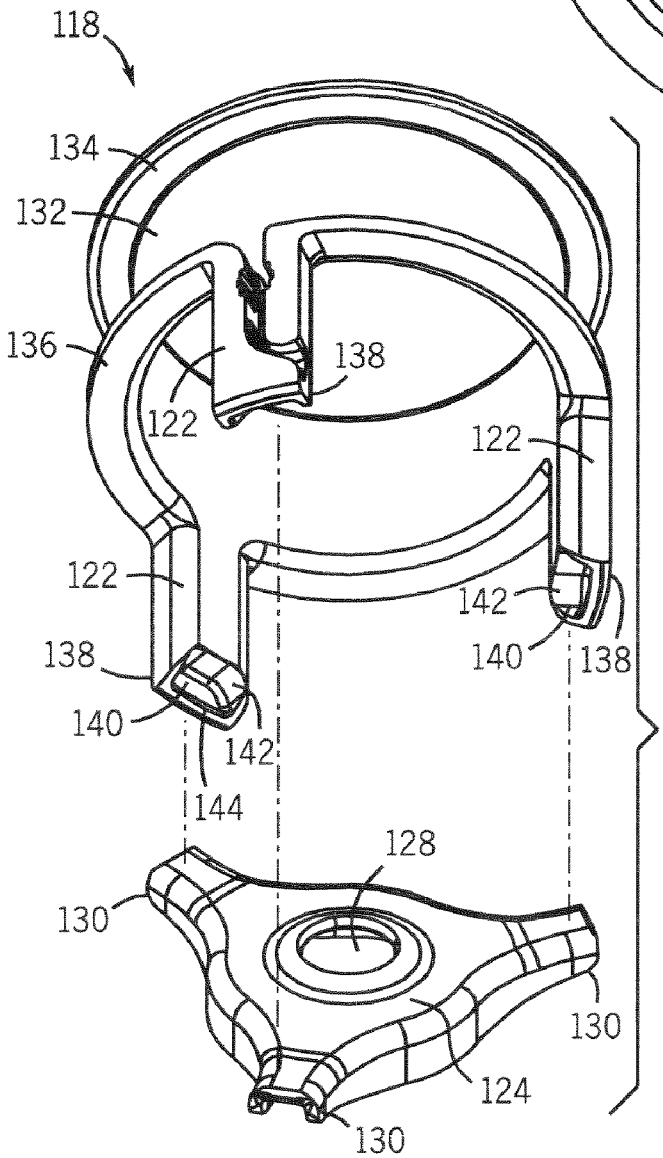
FIG. 6 is an exploded view of the bobbin and drive member of FIG. 5.

In FIGS. 5 and 6, taken along with FIG. 3, there are shown a bottom view and an exploded view of the coil bobbin 118 and drive member 124 in order to illustrate the assembly thereof. In the illustrated embodiment, drive member 124 forms a generally domed-shaped area 126 having a central aperture 128 for the passage of fluid and having a plurality of arms 130 that extend outwardly from the domed-shaped area 126. The distal ends of the arms 130 can be an inverted U-shaped configuration.

The coil bobbin 118 comprises a hub 132 around which the wire is wound in creating the coil 120 and has an upper flange 134 and a lower flange 136 to retain the coil 120 in position affixed to the coil bobbin 118. The bobbin legs 122 extend outwardly from the lower flange 136 and, as explained, are affixed to the drive member 124. At the distal ends 138 of the bobbin legs 122, there is a securing means that enables the arms 130 of the drive member 124 to simply be snap-fitted to the bobbin legs 122.

As shown, that securing means is a receptacle 140 formed in the distal ends 138 of each of the bobbin legs 122 so that the arms 130 of the drive member 124 can simply be inserted into the receptacles 140 and snap-fitted therein due to the slight flexibility of the bobbin legs 122. The coil bobbin 118 and its bobbin legs 122 can be formed of a metal material, such as stainless steel, so as to be slightly flexible to enable the snap fit affixation of the drive member 124 to the bobbin legs 122.

In the embodiment illustrated, the receptacles have an arcuate upper surface 142 so as to allow a sung but firm interfitting with an inverted U-shaped end of the arms 130 and allows the arms 130 to slip over the slightly inwardly directed lower edges 144 of receptacles 140.

Figure 7:
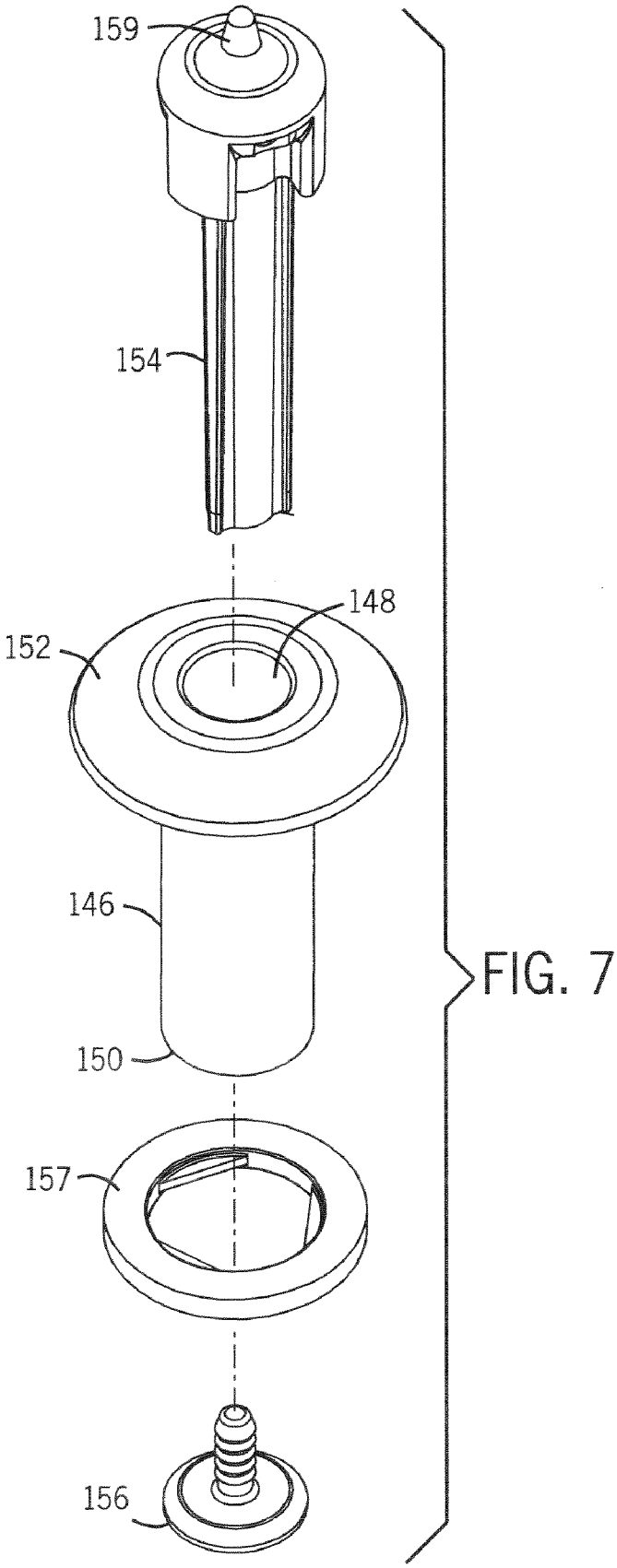
FIG. 7 is an exploded view of the pump plunger assembly used with the invention.

Turning now to FIG. 7, taken along with FIG. 3, the domed shaped area 126 of the drive member 124 aids in centering a plunger 146 which is disposed within a concave portion of the drive member 124. Plunger 146 preferably has a longitudinal passageway 148 extending from its lower end 150 to a head region 152 designed to contact and bear against drive member 124. A valve stem 154 is located in the longitudinal passageway while leaving the longitudinal passageway 148 open and a poppet head 156 is affixed to the lower end of the valve stem 154 proximate to the lower end 150 of the plunger 146 by a force fit. The valve stem 154 can be a plastic material to allow the poppet head 156 to be forcefully interfitted with a bore formed in the lower end of the valve stem 154.

There is also a bumper 157 that surrounds the body of the plunger 146 and is located just beneath the head region 152. The material for the bumper 157 is preferably a resilient plastic composition that can be force fitted to the body of the plunger 146. In addition, at the upper end of the valve stem 154, there is a nipple 159 formed of a deformable material such as pliable plastic composition and, as can be seen in FIG. 3, the nipple 159 passes through an opening 161 in the base plate 94 so as to abut against the permanent magnet 90. That abutting relationship between the pliable nipple 159 and the permanent magnet 90 enhances the stability of the valve stem 154 by means of the deformation of the nipple 159 as it forcefully abuts against the permanent magnet 90.

A biasing spring 158 is compressed between the head region 152 and a lower spring guide 163 of the pump section 84 to maintain the plunger 146, the drive member 124, valve stem 154, poppet head 156 and the assembly incorporating the coil bobbin 118 and coil 120 in an upward or biased position. As will be appreciated by those skilled in the art, plunger 146, drive member 124, bobbin legs 122, coil bobbin 118, coil 120, valve stem 154 and poppet head 156 thus form a reciprocating assembly which is driven in an oscillating motion during operation of the device as described more fully below.

The drive section 82 and pump section 84 are designed to interface with one another, preferably to permit separate manufacturing and installation of these components as subassemblies, and to permit their servicing as needed. In the illustrated embodiment, the lower skirt 96 of housing 86 of drive section 82 is secured within a peripheral wall 160 of pump section 84.

There is a gap 162 that is present between the lower end 150 of the plunger 146 and the poppet head 156 when the plunger 146 is in its retracted position as shown in FIG. 3. The gap 162 is formed by limiting the upward movement of the valve stem 154 such as by the upper end of the valve stem 154 encountering the permanent magnet 90. The fluid may fill the entire area within the plunger 146 when plunger 146 is advanced to its retracted position. As described more fully below, gap 162 permits the entire reciprocating assembly, including plunger 146, to gain momentum during a pumping stroke before contacting the poppet head 156 to force the valve stem 154 downwardly to compress and expel fluid from the pump section 84 while closing off any passage of fuel upwardly past the poppet head 156. At the lower end of the stroke, the bumper 157 may encounter the upper surface of the spring guide 163 such that the pliable material of the bumper 157 provides a resilient contact therewith.

The poppet head 156 is positioned within a pump chamber 164. Pump chamber 164 receives fluid from an inlet 166. Inlet 166 thus includes a fluid passage 168 through which fluid, such as pressurized fuel, is introduced into the pump chamber 164. An inlet check valve, indicated generally at reference numeral 170, is provided between fluid passage 168 and pump chamber 164, and is closed by the pressure created within pump chamber 164 during a pumping stroke of the device.

A further check valve 172 is located at the discharge area of the pump chamber 164 and comprises a valve member 174 that is biased by means of a spring 176 toward a valve seat 178 that may be an O-ring.

When the pump defined by the components described above is employed for direct fuel injection, as one exemplary utilization, a nozzle assembly 180 may be incorporated directly into a lower portion of the pump section 84. As shown in FIG. 3, an exemplary nozzle includes a nozzle body 182 which is sealingly fitted to the pump section 84. A poppet 184 is positioned within a central aperture formed in the nozzle body 182, and is sealed against the nozzle body 182 in a retracted position shown in FIG. 3. At an upper end of poppet 184, a retaining member 186 is provided. Retaining member 186 contacts a biasing spring 188 which is compressed between the nozzle body 182 and the retaining member 186 to maintain the poppet 184 in a biased, sealed position within the nozzle body 182.

Fluid is free to pass from pump chamber 164 through the check valve 172 and into the region surrounding the retaining member 186 and spring 188. This fluid is further permitted to enter into passages 190 formed in the nozzle body 182 around poppet 184. An elongated annular flow path 192 extends from passages 190 to the sealed end of the poppet 184. As will be appreciated by those skilled in the art, other components may be incorporated into the pump, the nozzle, or the drive section.

Accordingly, in the operation of the present invention, as shown in FIG. 3, upon application of energizing current to the coil 120, the coil 120, coil bobbin 118, bobbin legs 122, and drive member 124 are displaced downwardly. This downward displacement is the result of interaction between the electromagnetic field surrounding coil 120 by application of the energizing current thereto, and the magnetic field present by virtue of permanent magnets 88 and 90. As drive member 124 is forced downwardly by interaction of these fields, it contacts plunger 146 to force the plunger 146 downwardly against the resistance of biasing spring 158.

During an initial phase of this displacement, plunger 146 is free to move downwardly without contact with poppet head 156, by virtue of gap 162. Plunger 146 thus gains momentum, and eventually contacts the upper surface of poppet head 156. The lower end 150 of plunger 146 seats against and seals with the upper surface of poppet head 156, to prevent flow of fluid upwardly through passage 148 of the plunger 146, or between the plunger 146 and central aperture 128 (FIGS. 5 & 6) of the pump section 84. Further downward movement of the plunger 146 and poppet head 156 begin to compress fluid within pump chamber 164, closing inlet check valve 170.

Still further movement of the plunger and valve member thus produces a pressure surge or spike which is transmitted downstream, such as to nozzle assembly 180. In the illustrated embodiment, this pressure surge forces poppet 184 to unseat from the nozzle body 182, moving downwardly with respect to the nozzle body 182 by a compression of spring 188 between retaining member 186 and the nozzle body 182. Fluid, such as fuel, is thus sprayed or released from the nozzle assembly 180, such as directly into a combustion chamber of an internal combustion engine as described above with reference to FIG. 2.

As will be appreciated by those skilled in the art, upon reversal of the polarity of the drive or control signal applied to coil 120, an electromagnetic field surrounding the coil 120 will reverse in orientation, causing an oppositely oriented force to be exerted on the coil 120 by virtue of interaction between this field and the magnetic field produced by magnets 88 and 90. This force will thus drive the coil 120, and other components of the reciprocating assembly back toward their original position. In the illustrated embodiment, as drive member 124 is driven upwardly, biasing spring 158 urges plunger 146 upwardly towards its original position. Gap 162 is reestablished as illustrated in FIG. 3, and a new pumping cycle may begin. Where a nozzle assembly 180 such as that shown in FIG. 3 is provided, the nozzle assembly 180 is similarly closed by the force of spring 188. In this case, as well as where no such nozzle assembly 180 is provided, pressure is reduced within pump chamber 164 to permit inlet check valve 170 to reopen for introduction of fluid for a subsequent pumping cycle.

By appropriately configuring drive signals applied to coil 120, the device of the present invention may be driven in a wide variety of manners. For example, in a conventional pumping application, shaped alternating polarity signals may be applied to the coil to cause reciprocating movement at a frequency equal to the frequency of the control signals. Displacement of the pump, and the displacement per cycle, may thus be controlled by appropriately configuring the control signals (i.e. altering their frequency and duration). Pressure variations may also be accommodated in the device, such as to conform to output pressure needs. This may be accomplished by altering the amplitude of the control signals to provide greater or lesser force by virtue of the interaction of the resulting electromagnetic field and the magnetic field of the permanent magnets in the drive section.

The foregoing structure may be subject to a variety of adaptations and alterations, particularly in the configuration of the coil, bobbin, permanent magnet structures, and drive components of the drive section.

The present invention has been described in terms of the preferred embodiment, and it is recognized that equivalents, alternatives, and modifications, aside from those expressly stated, are possible and within the scope of the appended claims. While the present invention is shown as being incorporated into an outboard motor, the present invention is equally capable of use with other recreational products, some of which include inboard motors, snowmobiles, personal watercrafts, all-terrain vehicles (ATV's), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of consumers are radically different between the recreational products industry and the automotive industry. As is readily apparent, the recreational products industry is one in which size, packaging, and weight are all at the forefront of the design process, and while these factors may be somewhat important in the automobile industry, it is quite clear that these criteria take a back seat to many other factors, as evidenced by the proliferation of larger vehicles such as sports utility vehicles (SUVs).

What is claimed is:

1. A reciprocating fuel pump comprising:

a pump assembly including a drive section and a pump section;

a drive assembly disposed in the drive section, the drive assembly providing a reciprocating motion to a drive member;

said pump section having a pump chamber, an inlet for introducing a fluid into the pump chamber and an outlet for fluid to be expressed from the pump chamber;

a plunger assembly comprising a plunger having an upper head region contacting the drive member, a lower end and a longitudinally extending passageway therebetween; and a valve stem movably located within the passageway and having a lower end including a poppet head, the plunger having an upper position where fluid can be introduced into the pump chamber through the inlet and a lower position where the fluid is forcefully pumped from the pump chamber through the outlet, the reciprocating motion of the drive member moving the plunger between said upper and lower positions, the plunger contacting said poppet head of said valve stem as said plunger moves from said upper position toward said lower position to forcefully move said valve stem into the pump chamber to pump the fluid in the pump chamber outwardly through the outlet.

2. The reciprocating fuel pump as defined in claim 1 wherein said poppet head is displaced away from said lower end of said plunger when said plunger is in said upper position to create a gap between the lower end of the plunger and the poppet head.

3. The reciprocating fuel pump as defined in claim 2 wherein said movement of said plunger toward its lower position moves the lower end of said plunger with respect to said valve stem to close the gap to seal the passageway.

4. The reciprocating fuel pump as defined in claim 3 wherein said poppet head is press fitted with a bore in the valve stem.

5. The reciprocating fuel pump as defined in claim 1 wherein the plunger assembly further includes a pliable bumper affixed to said plunger and located beneath the upper head region.

6. The reciprocating fuel pump as defined in claim 1, the valve stem further comprising an upper end;

wherein the upper end of said valve stem includes a pliable nipple that forcefully abuts a component of the drive section when said plunger is in said upper position.

7. The reciprocating fuel pump as defined in claim 6 wherein said drive assembly includes at least one permanent magnet and said pliable nipple abuts against said at least one permanent magnet.

8. The reciprocating fuel pump as defined in claim 7 wherein said pliable nipple is comprised of a deformable plastic material and deforms by abutting against said at least one permanent magnet to stabilize the plunger.

9. The reciprocating fuel pump as defined in claim 1 wherein the upper head region has an enlarged upper surface that interfits into a complementarily configured lower surface of the drive member.

10. A reciprocating fuel pump comprising:

a pump assembly including a drive section and a pump section;

a drive assembly disposed in the drive section, the drive assembly including at least one permanent magnet and a coil assembly disposed within a magnetic field of the at least one permanent magnet, said coil assembly movable reciprocally axially along a central axis upon application of alternating current power to the coil assembly;

said coil assembly comprising a coil bobbin and a coil contained within the coil bobbin, and a drive member actuated by the reciprocating movement of the coil assembly;

said pump section comprising a pump chamber for containing a quantity of fluid and having an inlet and an outlet, and a plunger assembly to pump fluid from the pump chamber; and said plunger assembly comprising a plunger having an upper head region contacting the drive member, a lower end and a longitudinally extending passageway therebetween, a valve stem movably located within the passageway, the valve stem having an upper end and a lower end including a poppet head, the plunger having an upper position where fluid can be introduced into the pump chamber through the inlet and a lower position where the fluid is forcefully pumped from the pump chamber through the outlet, the reciprocating motion of the drive member moving the plunger between said upper and lower positions, the plunger contacting said poppet head of said valve stem as said plunger moves from said upper position toward said lower position to forcefully move said valve stem into the pump chamber to pump the fluid in the pump chamber outwardly through the outlet.

11. The reciprocating fuel pump as defined in claim 10 wherein said upper head region is an enlarged area having a surface that interfits with a contour of the drive member.

12. The reciprocating fuel pump as defined in claim 10 wherein the poppet head is displaced away from said lower end of said plunger when said plunger is in said upper position to create a gap between the lower end of the plunger and the poppet head.

13. The reciprocating fuel pump as defined in claim 12 wherein said movement of said plunger toward the lower position moves the lower end of said plunger with respect to said valve stem to close the gap to seal the passageway.

14. The reciprocating fuel pump as defined in claim 10 wherein the upper end of said valve stem includes a pliable nipple that forcefully abuts against the at least one permanent magnet when said plunger is in said upper position.

15. The reciprocating fuel pump as defined in claim 14 wherein the pliable nipple deforms by the abutting with the at least one permanent magnet to stabilize the valve stem within the plunger.

16. A method of pumping a fluid from a reciprocating pump comprising:

providing a pump assembly having a drive section and a pump section having a pump chamber containing fluid and having an inlet and an outlet, the drive section producing a reciprocating motion upon activation of an electrical signal;

providing a plunger assembly within the pump section, the plunger assembly including a plunger and a valve stem movably located within the plunger, the valve stem having a lower poppet head;

transmitting the reciprocating motion of the drive section to the plunger to move the plunger between an upper position where fluid can enter the pump chamber through the inlet and a lower position where the plunger forces fluid from the pump chamber through the outlet; and activating the electrical signal to drive the plunger into contact with the poppet head to move both the plunger and the valve stem into the pump chamber to move the plunger to its lower position.

17. The method of claim 16 wherein the plunger assembly further comprises a gap between a lower end of the plunger and the poppet head of the valve stem.

18. The method of claim 17 wherein activating the electrical signal causes the plunger to move the distance of the gap before contacting the poppet head as the plunger moves to the lower position.

19. The method of claim 18 wherein the valve stem further comprises an upper pliable nipple formed thereon that abuts against a fixed component of the pump assembly when the plunger is in the upper position to stabilize the valve stem.

20. The method of claim 18 wherein the valve stem comprises plastic and the poppet head is force fitted within a bore formed in the valve stem.

* * * * *